US007243693B1

(12) United States Patent
Mellott

(10) Patent No.: US 7,243,693 B1
(45) Date of Patent: Jul. 17, 2007

(54) LOG DEBARKING MACHINE AND METHOD

(75) Inventor: Samuel H. Mellott, Mercersburg, PA (US)

(73) Assignee: Mellott Manufacturing Co., Inc., Mercersburg, PA (US)

( * ) Notice: Subject to any disclaimer, the term of this patent is extended or adjusted under 35 U.S.C. 154(b) by 0 days.

(21) Appl. No.: 11/422,713

(22) Filed: Jun. 7, 2006

(51) Int. Cl.
*B27L 1/00* (2006.01)

(52) U.S. Cl. ..... 144/208.1; 144/208.4

(58) Field of Classification Search ... 144/208.1–208.9
See application file for complete search history.

(56) References Cited

U.S. PATENT DOCUMENTS

| | | | | |
|---|---|---|---|---|
| 2,830,630 | A | 4/1958 | Uhlenkott | 144/208 |
| 2,841,195 | A | 7/1958 | Fulghum | 144/208 |
| 2,897,859 | A | 8/1959 | Annis | 144/247 |
| 3,008,503 | A | 11/1961 | Hilborn | 144/208 |
| 3,082,801 | A | 3/1963 | Dillingham | 144/208 |
| 3,196,912 | A | 7/1965 | Brundell et al. | 144/206 |
| 3,324,909 | A * | 6/1967 | McCranie | 144/375 |
| 3,351,109 | A | 11/1967 | Schurman | 144/208 |
| 3,416,581 | A | 12/1968 | Parrish et al. | 144/208 |
| 3,709,269 | A | 1/1973 | Cervenak | 144/208 E |
| 3,892,266 | A | 7/1975 | Puna | 144/309 |
| 3,987,825 | A * | 10/1976 | Vignolles | 144/208.4 |
| 4,249,585 | A | 2/1981 | Mellott | 144/208 G |
| 4,540,031 | A | 9/1985 | Kvarnang | 144/2 R |
| 5,638,878 | A | 6/1997 | Weirathmueller | 144/208.6 |
| 6,776,202 | B1 * | 8/2004 | Dziesinski et al. | 144/208.1 |

OTHER PUBLICATIONS

Superior Bungee Corporation (www.superiorbungee.com), 6 Pages, Before Jun. 2005.

Building N624WG (Bungee Cord Shock Absorber), 2 Pages, Before Jun. 2005.

It is old to mount a pivotal cutter head assembly (80) on the inner end of an arm frame (86) as described in the paragraph bridging pp. 6 and 7 as shown in Figure 6.

* cited by examiner

*Primary Examiner*—Shelley M. Self
(74) *Attorney, Agent, or Firm*—Hooker & Habib, P.C.

(57) ABSTRACT

A log debarking machine includes a rotary cutter head on a debarking arm. The arm is pivotally mounted on a car so that the head engages a rotating log. The weight of the arm is supported by an elastomer spring to improve debarking engagement between the head and the log.

25 Claims, 8 Drawing Sheets

LOG DEBARKING MACHINE AND METHOD

FIELD OF THE INVENTION

The invention relates to machines for removing bark from rotating logs and to methods for debarking logs.

DESCRIPTION OF THE PRIOR ART

Logs are conventionally debarked by rotating the logs and holding a rotary cutter head against the logs to remove bark. The rotary cutter head is mounted on a debarking arm pivotally mounted on a car located to one side of the rotating log. The arm is pivoted down to bring the rotating head into engagement with the rotating log to remove bark. Bark is preferably removed from the log by holding the head against the log with a relatively low contact force of a few hundred pounds.

The weight of the heavy pivot arm is typically supported by a hydraulic cylinder and metal coil springs to prevent undesirably high contact force between the head and log. Nitrogen accumulators bias the hydraulic cylinder to hold the head against the rotating log at the desired low contact force as the diameter of the log changes.

The hydraulic cylinders and metal springs in conventional debarkers do not maintain a low contact force between the head and the surface of the rotating log as the head moves into recesses in the log and over projections on the log. When the head contacts irregularities in the log it can snap away from the log and then rebound back against the log. Rebound of the head can increase cut depth and stress and injure the drive for rotating the head. The head does not float smoothly over the surface of the log.

Additionally, in conventional debarking machines where the contact force for the head is maintained by a hydraulic cylinder and accumulators, the pressure of the nitrogen in the accumulators must be adjusted as the diameter of the log and the pivot position of the arm change in order to maintain the desired contact force between the cutter head and the log. Adjusting the pressure of the nitrogen in the accumulators is time consuming and slows the debarking.

Accordingly, there is a need for an improved debarker and method using a pivotal debarking arm in which the weight of the arm is supported by a spring which permits the head to float over irregularities in the log so that the cutter head follows depressions and projections on the log and, if moved out of engagement with the log by depressions and projections, is brought back smoothly into engagement to the log without digging into the log or injury to the drive train for the head.

Additionally, there is need for an improved log debarker and method using a pivoting debarking arm with a rotary cutter head on an end of the arm and a hydraulic cylinder with accumulators to hold the head against a log which permits movement of the head for debarking large and small diameter logs without the necessity of readjusting the pressure in accumulators to maintain a desired contact force between the cutter head and log.

SUMMARY OF THE INVENTION

The invention is an improved log debarking machine and method in which a pivotal debarking arm with a rotary cutter head on the end of the arm is held over a rotating log by an elastomer spring. The elastomer spring supports the weight of the head during debarking. A hydraulic cylinder with nitrogen accumulators biases the arm downwardly to maintain a relatively constant contact force between the cutter head on the log about 100-200 pounds independent of the diameter of the log being debarked.

During debarking the elastomer spring maintains the head in floating engagement with the log so that when recesses and projections are encountered by the head the head moves into the recesses and over the projections in a floating manner without rapid snap back or head rebound contact with the log experienced in conventional debarkers using a metal arm support spring. Logs are debarked smoothly, without impact injury to the head or head drive.

The pressure of the nitrogen in the accumulator does not have to be adjusted as the arm pivots through its operational range.

Use of the elastomer spring improves the quality of debarking, and increases the longevity of the debarker by reducing the impact shocks experienced during snap back engagement with the rotating log. Debarking is improved and speeded. The longevity of the machine is increased.

DESCRIPTION OF THE PREFERRED EMBODIMENTS

Figure 1:
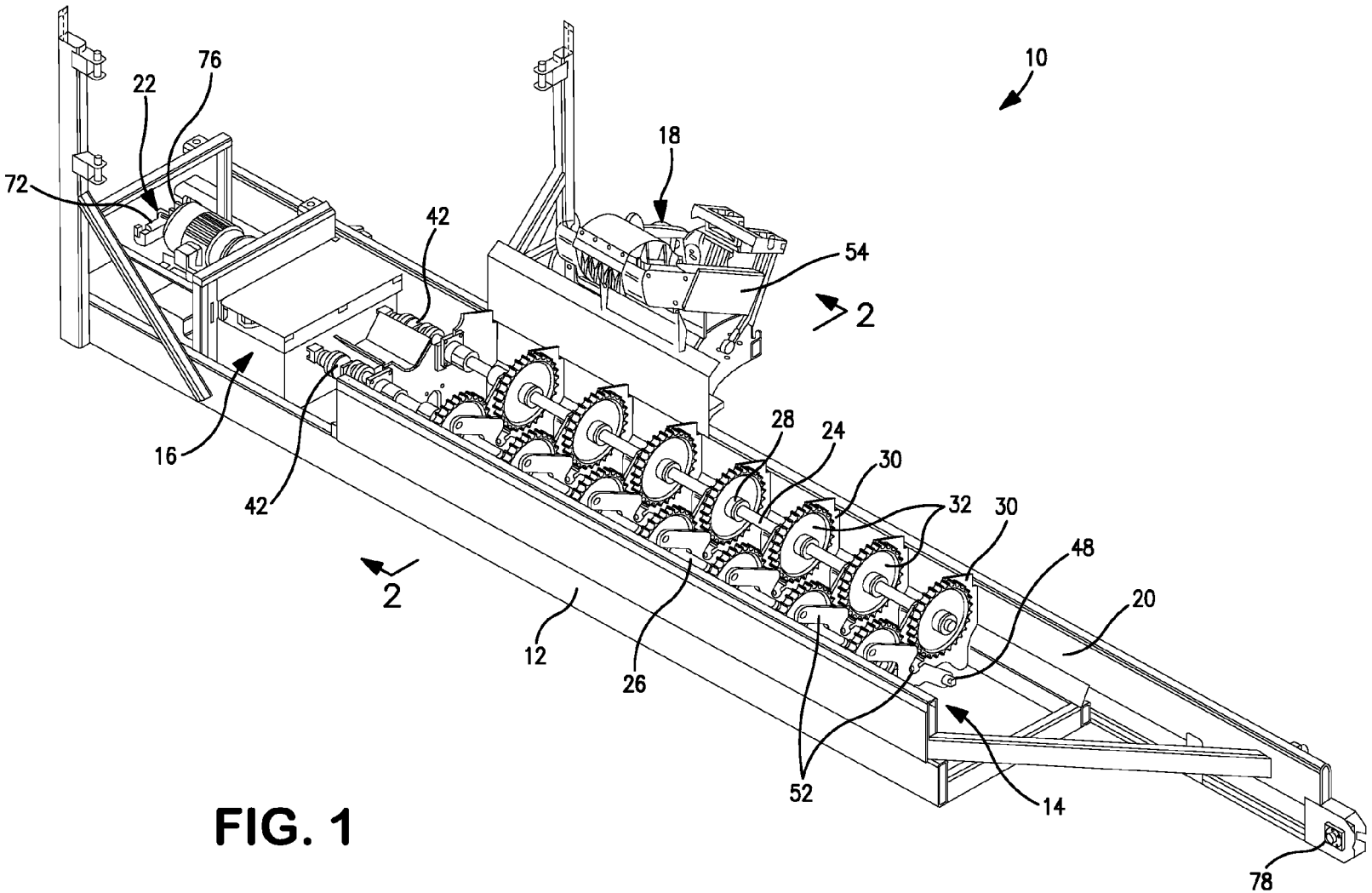
FIG. 1 is a perspective view of a debarking apparatus according to the invention.

The disclosed debarker is related to the debarker disclosed in Mellott, U.S. Pat. No. 4,249,585, the disclosure of which is hereby incorporated by reference.

Log debarking apparatus 10 includes an elongate base 12 and a rotary log support 14 on the base. The support is powered by log support drive 16 located at one end of the base. Debarker assembly 18 is mounted on rail 20 running along one side of base 12 and extends over a log on support 14. Assembly 18 is moved back and forth along rail 20 by debarker car drive assembly 22.

Log support 14 includes two spaced, parallel log support shafts 24 and 26 extending along base 12. Shafts 24 and 26 are rotatably mounted in bearings in support plates 30 on base 12. A number of log support wheels 32 having hubs 28 are mounted on and are spaced along each shaft 24 and 26. Each wheel 32 has a plurality of cleats or projections spaced around its rim and is located adjacent to another wheel 32 on an adjacent shaft 24 or 26. The top portions of wheels 32 form a trough 34 in which a log 36 is placed for debarking.

Log support drive 16 includes a hydraulic motor (not illustrated) with drive output shafts 42 coupled to shafts 24 and 26 to rotate the shafts in the directions of arrows 44 and 46 and rotate log 36 in the opposite direction.

Log kickoff shaft 48 is rotatably mounted in bearings 50 on lower portions of plates 30. Shaft 48 is located beneath shaft 24 and supports a plurality of log kick-off arms 52 to form a log ejection system like the system described in Mellott, U.S. Pat. No. 4,249,585. A suitable cylinder (not illustrated) rotates shaft 48 to lift arms 52 and eject a debarked log 36 from apparatus 10.

Debarker assembly 18 includes a car 54 mounted on rail 20. The car has a vertically extending body 56 located outside of the rail with an arm support shoulder 58 at the top of the body and extending away from log support 14. Pivot debarking arm 60 is located above car 54 and includes an inner end 55 over log 36 and an outer end 57 above shoulder 58. The pivot shaft 62 on arm 60 is journaled in bearings on shoulder 58 to permit the arm to pivot about the shaft and move end 55 toward and away from log 36. Pivot arm 60 extends from shaft 62 on the outer end of the arm inwardly over rail 20 and over log 36 in log support 14.

Two spaced pairs of upper and lower rollers 64 and 66 are mounted on body 56 and engage angled tracks 68 and 70 on the top and bottom of rail 20 to support the car 54 on the rail and permit movement of the car on the rail back and forth along log 36 on support 14.

Car 54 is moved along rail 20 by debarker car drive assembly 22. Drive assembly 22 includes a motor 72 and a shift roller chain 74. One end of chain 74 is attached to the adjacent side of car 54, extends to drive reel 76, is wound around the reel, runs from reel 76 along rail 20 to end sprocket gear 78, is wound around the sprocket gear and runs back to car 54. Motor 72 rotates the reel to move car 54 to a desired debarking position on the rail.

Pivot debarking arm 60 includes an arm frame 86 located above rail 20 and two downwardly extending shaft support plates 88 on either side of the outer end 57 of the arm. Shaft 62 is mounted on plates 88.

Cutter head assembly 80 is secured to the inner end 55 of arm 60 and includes a head support frame or member 90 and rotary cutter head 82 having a barrel and a number of cutting lugs or teeth 84. The rotary shaft for cutter head 82 is journaled in bearings on frame 90. The ends of the shaft extend outwardly beyond the bearings and carry belt pulleys 92. The cutter head assembly 80 is pivotally mounted on arm frame 86. Pivot shaft 110 is journaled in bearings on the frame 86. The shaft extends through plate 112 and carries locking rotary nuts 114 on either side of the plate to permit installation, removal and tensioning of belts 100. The end of shaft 110 adjacent the inner end of arm 60 is mounted on the adjacent side of head frame 90 to permit limited pivotal rotation of the head frame and cutter head 82 about the axis of shaft 110 during debarking so that the head follows the surface of a log.

Drive shaft 94 is journaled in bearings located on the outer end of frame 86 above shaft 62. Pulleys 96 are mounted on the ends of shaft 94. An additional pulley 98 is mounted on the end of the shaft 94 on the right hand side of the shaft as viewed in FIG. 6. Drive belts 100 are wound around adjacent pairs of pulleys 92 and 96.

Figure 6:
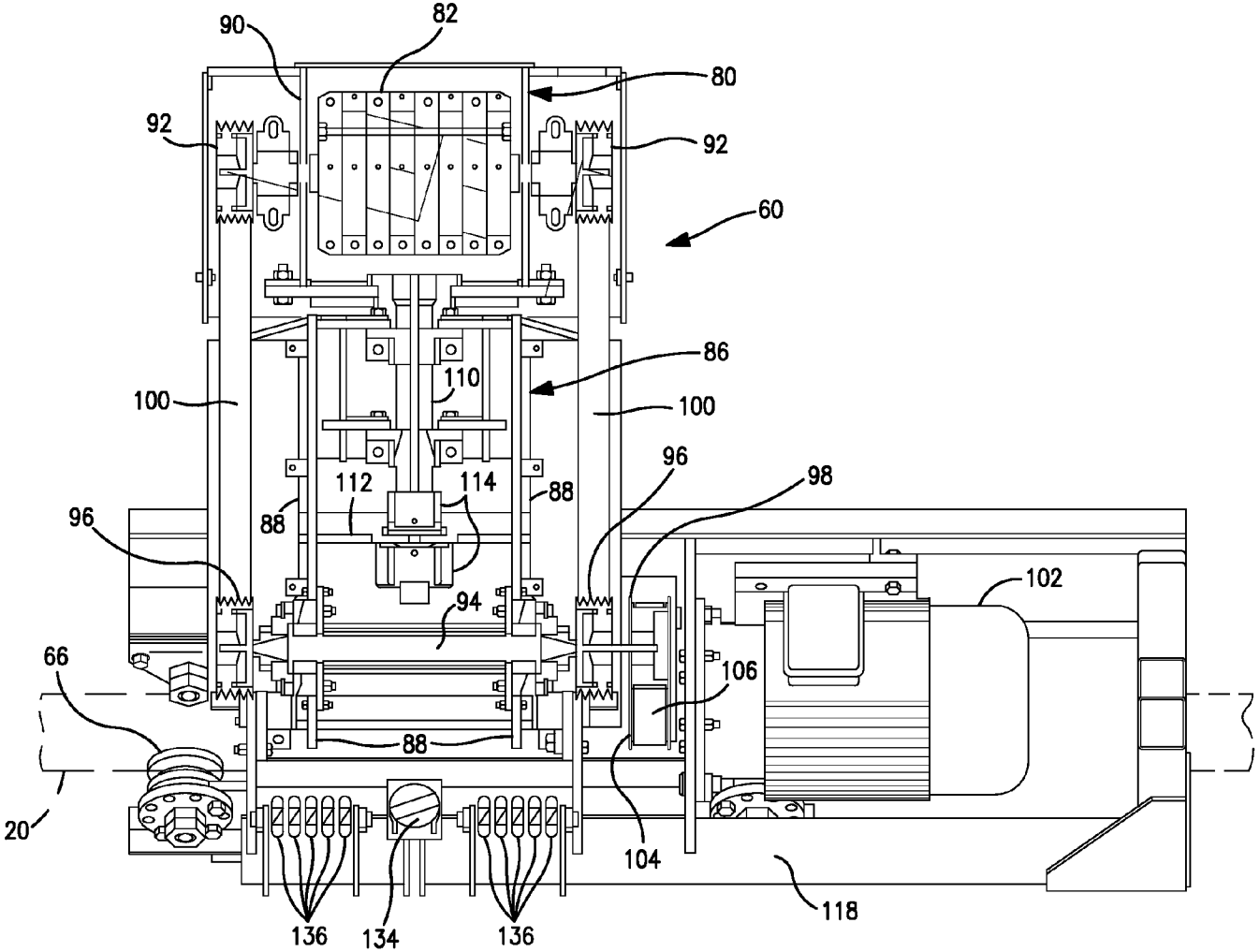
FIG. 6 is a sectional view taken generally along line 6-6 of FIG. 2.

Cutter drive motor 102 is mounted on car 54 on the right hand side of debarking arm 60 as shown in FIG. 6. The output shaft for motor 102 is coaxial with arm pivot shaft 62. Pulley 104 is mounted on the end of the drive shaft under pulley 98. Belt 106 is wound around pulleys 104 and 98. During operation of apparatus 10 motor 102 continuously rotates cutter head 82 in the direction of arrow 108 shown in FIG. 2.

Car 54 includes three parallel plates 116 spaced along rail 20 and perpendicular to the rail. See FIG. 4. The plates 116 extend along the vertical portion of body 56 adjacent the rail and outwardly from the rail at shoulder 58. Mounting bar 118 is secured to the outer portions of plates 116 at shoulder 58. Support brackets for elastomer springs and a hydraulic cylinder are attached to bar 118.

Figure 2:
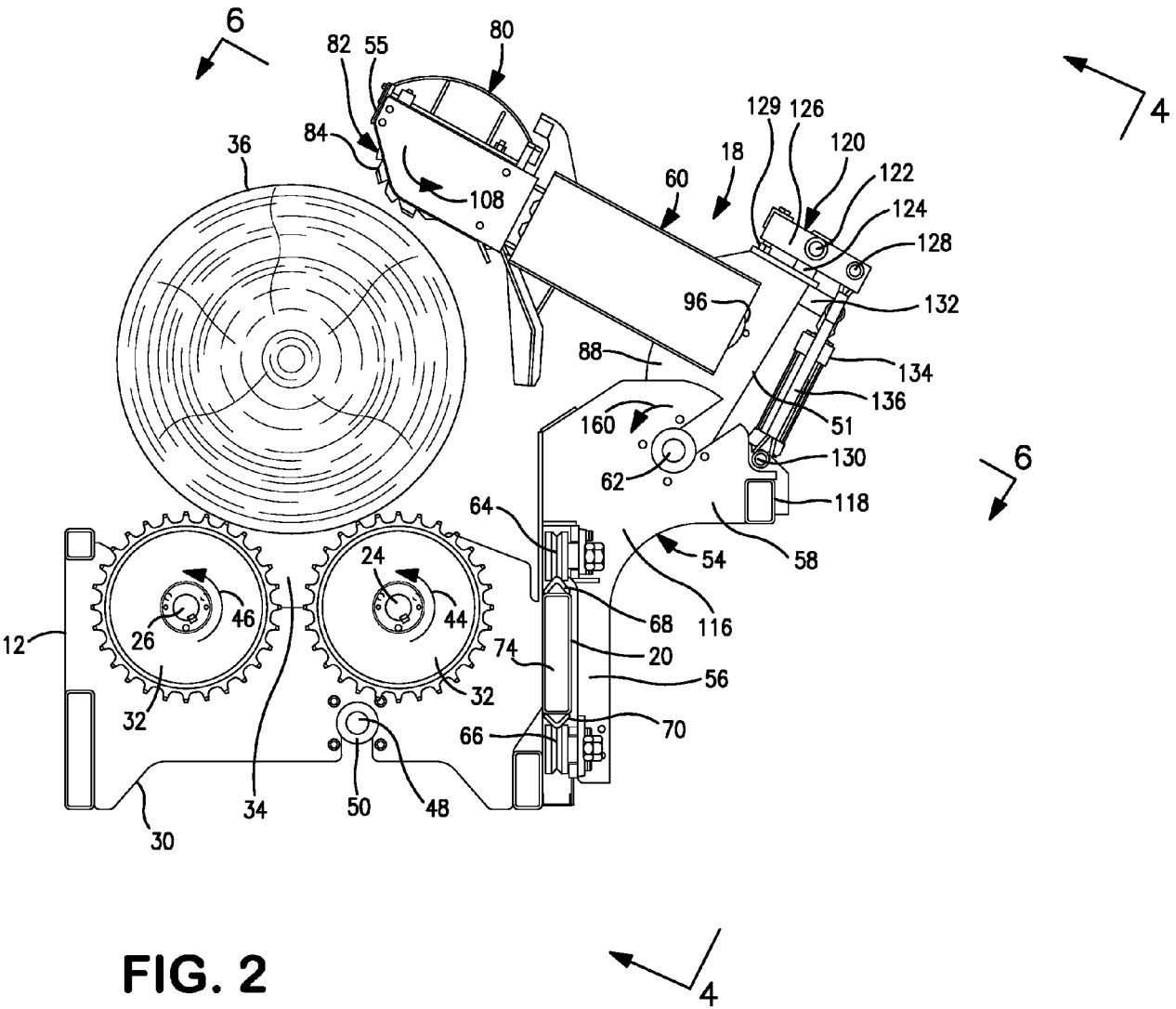
FIG. 2 is a sectional view taken along line 2-2 of FIG. 1 showing the debarking arm in an elevated position.
Figure 4:
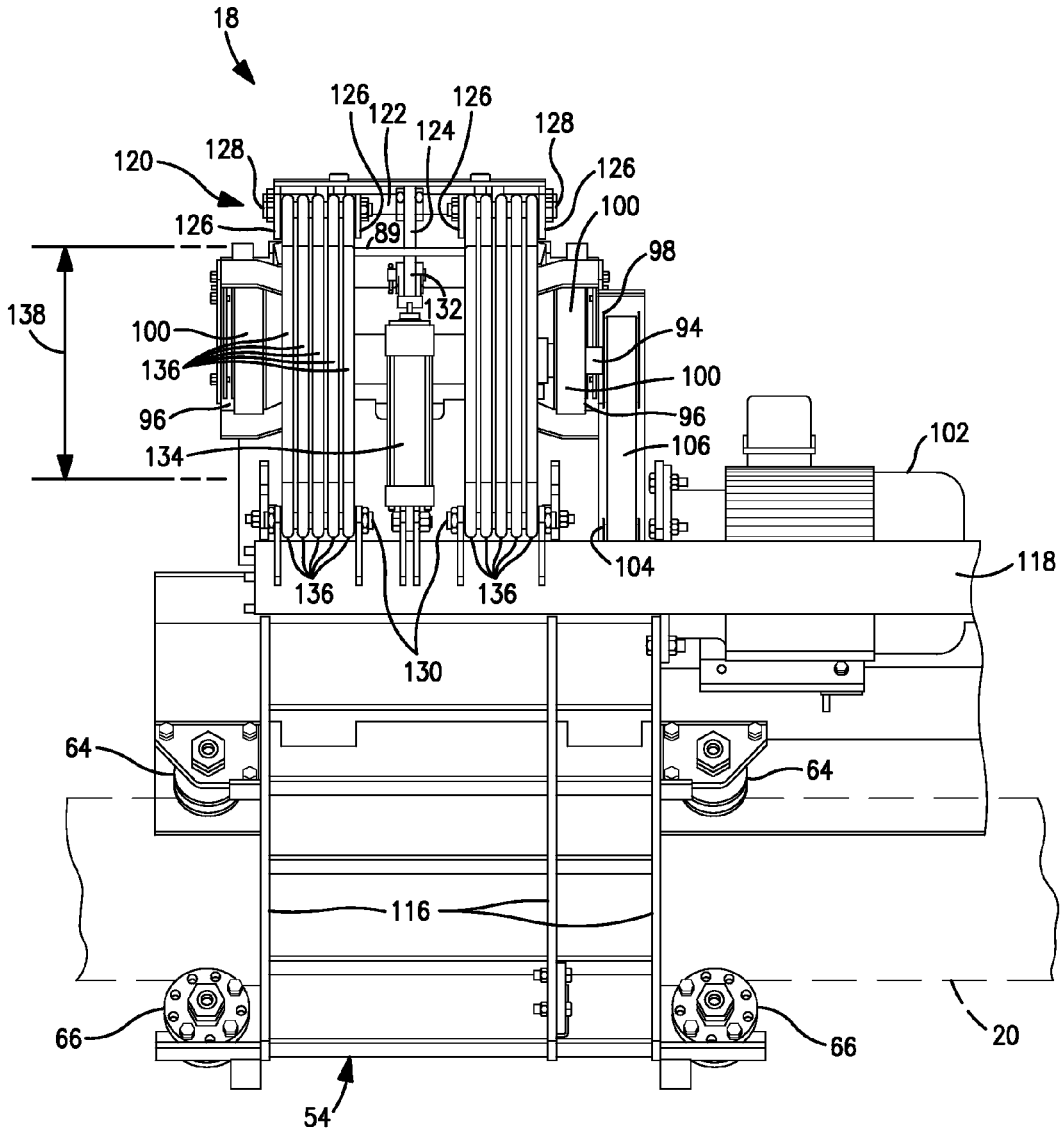
FIG. 4 is a view taken along line 4-4 of FIG. 2.

Elastomer spring tensioning assembly 120 is rotatably mounted on support plates 88 above shaft 62. The assembly includes a shaft 122 supported by three plates 124 extending upwardly from the support plate 89 on the tops of plates 88 as shown in FIGS. 2 and 4. Two pairs of arms 126 are pivotally mounted on shaft 122 and extend to either side of the shaft. The arms extend outwardly beyond the side of body 56 away from log support 14. Pins 128 extend through the outer ends of each pair of arms 126 as shown in FIG. 4.

The inner ends of the arms 126 are joined and adjustably connected to the top of body 56 by threaded connections 129 to permit rotation of the assembly 120 about shaft 122 to move the pins 128 toward and away from mounting pins 130 extending through brackets on bar 118. See FIGS. 4 and 5.

Mounting bar 132 extends outwardly from the top of car body 56 under the assembly 120. The rod end of hydraulic cylinder 134 is secured to bar 132. The body end of the cylinder is secured to brackets on bar 118 on body 56. The cylinder has a 10 inch stroke.

Figure 5:
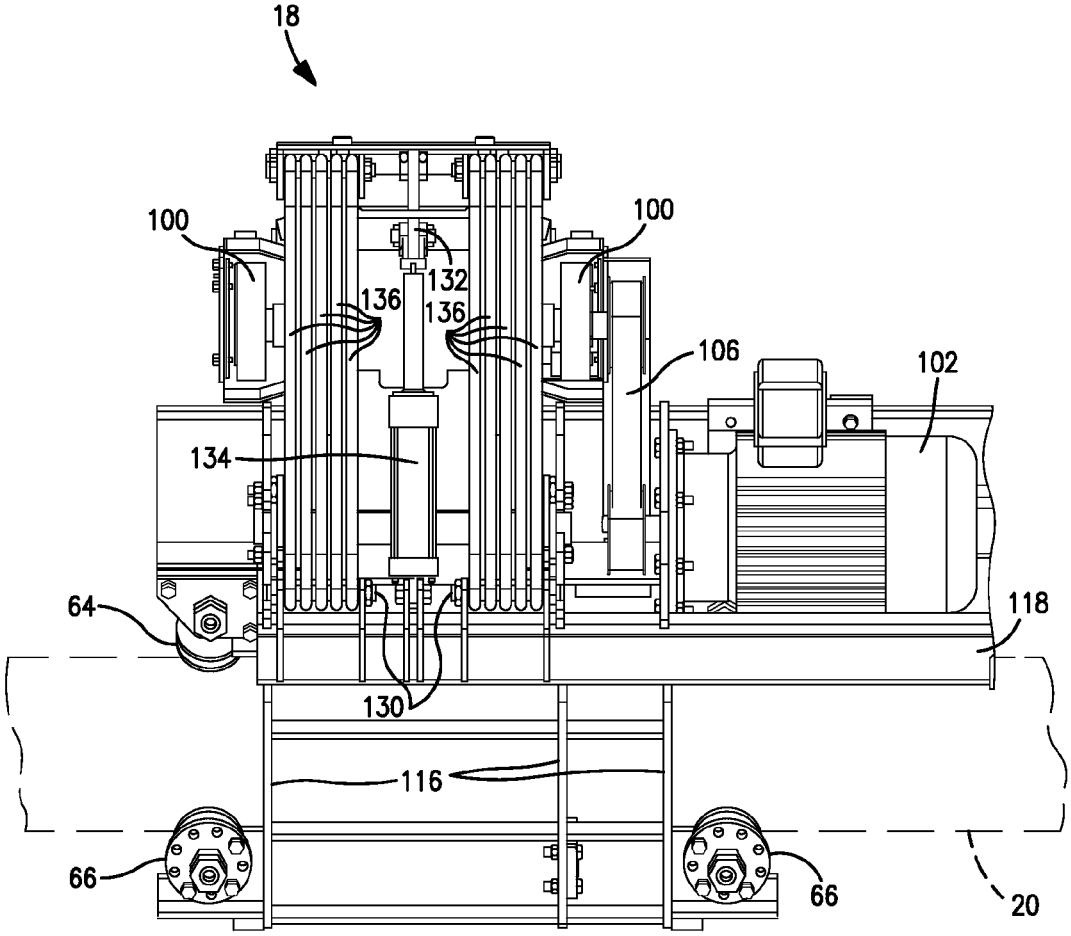
FIG. 5 is a view taken along line 5-5 of FIG. 3.
Figure 8:
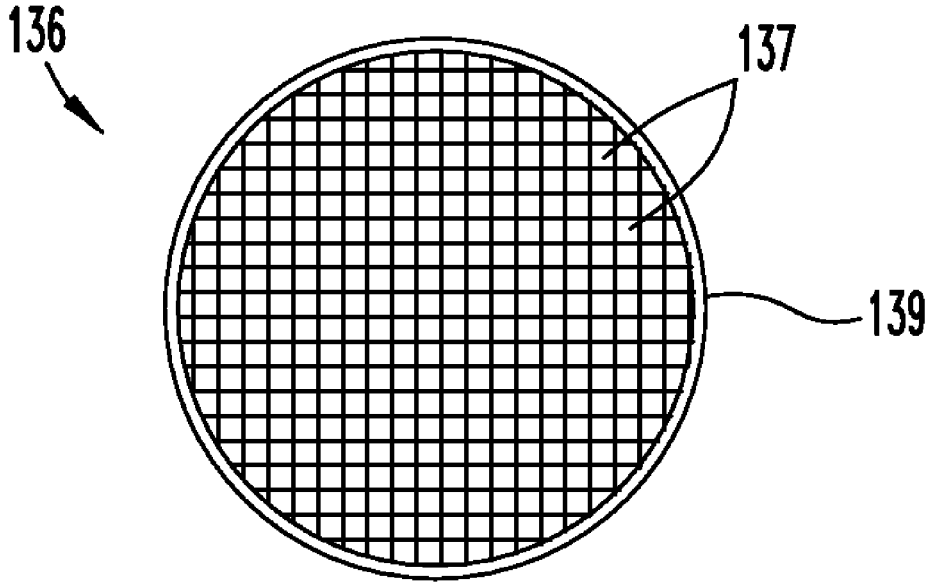
FIG. 8 is a simplified cross-sectional view of a bungee cord elastomer spring used in the debarking apparatus.

Five bungee cord elastomer springs 136 are mounted between opposed pair of pins 128 and 130 on each side of hydraulic cylinder 134 as shown in FIGS. 4 and 5. Each bungee cord includes a large number of rubber strands 137 held together in a flexible sheath 139 (see FIG. 8) surrounding the strands and eyes at the ends of the spring. The sheath permits elongation of the strands. Pins 128, 130 extend through the eyes. The springs have a free length 138 of cylindrical bungee cord extending between the whipping at each eye at the ends of the spring. See FIG. 4. The elastomer springs 136 are preferably made from 1-inch diameter Military Specification bungee cord available from Superior Bungee Corporation, 249 West Laurel Street, Scottsboro, Ala. 35768. The bungee cord can elastically stretch approximately 70 or 75% its rest length without deformation. The free length of bungee springs 136 is about 14 inches to assure that the springs are not overstressed when cylinder 134 is fully extended 10 inches.

Five springs 136 are located to each side of central cylinder 134 to prevent unequal force exerted on arm 60 and binding. The cylinder 134 is located at the center of the arm for the same reason.

Figure 7:
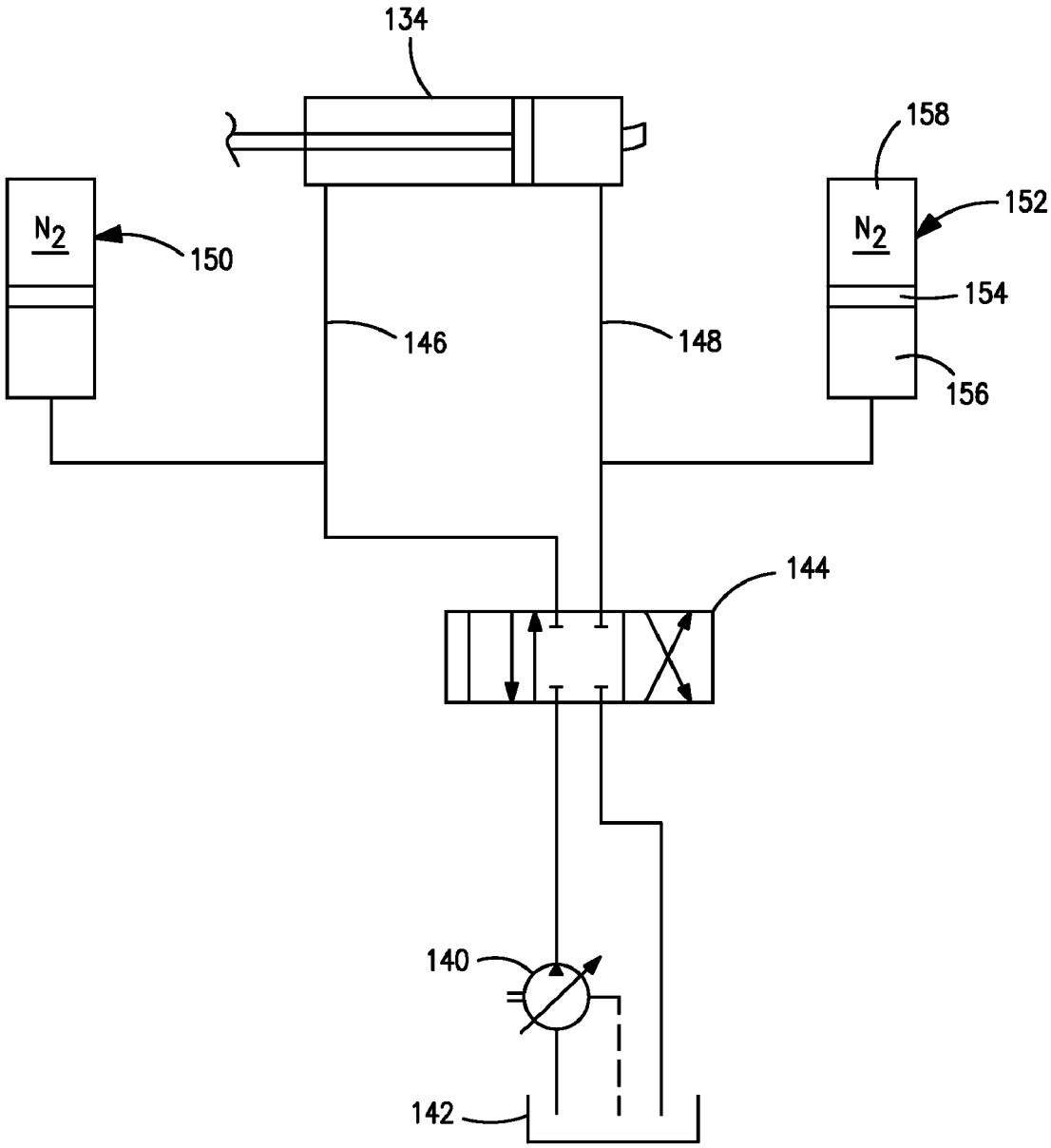
FIG. 7 illustrates the hydraulic circuit for the cylinder that rotates the debarking arm between the elevated and lowered positions.

FIG. 7 illustrates the hydraulic circuitry for cylinder 134. Continuously operating hydraulic pump 140 flows hydraulic fluid from reservoir 142 to an inlet port of operator controlled, normally closed valve 144. When the valve is closed the fluid is flowed back to the reservoir. The work ports of valve 144 are connected to the works ports of hydraulic cylinder 134 through lines 146 and 148. The return port of valve 144 is connected to the reservoir 142. Nitrogen accumulator 150 is connected to line 146. Nitrogen accumulator 152 is connected to line 148. Each accumulator includes a piston 154, a hydraulic fluid chamber 156 and a pressurized nitrogen chamber 158. The hydraulic fluid chambers 156 are connected to lines 146 and 148.

Use of elastomer springs 136 and cylinder 134 mounted on the outer end 57 of arm 60 results in a very compact debarker extending a minimum distance outwardly from rail 20. The compact design occupies minimum space in debarking facilities and sawmills.

Figure 3:
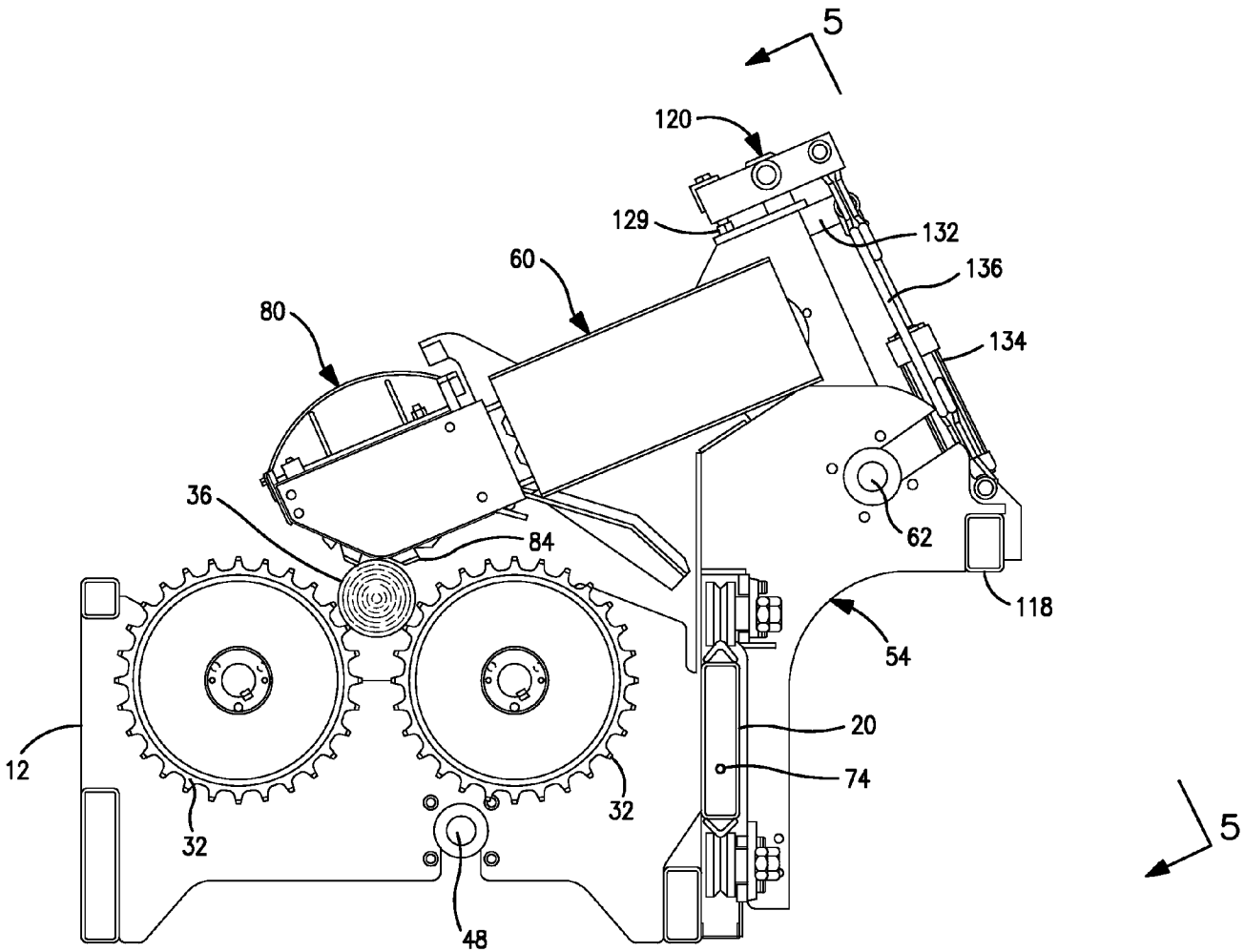
FIG. 3 is sectional view similar to FIG. 2 but with the debarking arm in a lowered position.

When cylinder 134 is retracted debarking arm is rotated up to an elevated position shown in FIG. 2 with arm 60 about 30° above horizontal and the cutter head 82 sufficiently far above log support wheels 32 to permit positioning a 4 foot diameter log 36 on the wheels for debarking. When the cylinder is extended arm 60 is rotated in the direction of arrow 160 around shaft 62 down to a lowered position of FIG. 3 with arm 60 about 30° below the horizontal and head 82 in position for debarking a small diameter log.

Tensioning assembly 120 is adjusted so that when the arm is in the elevated position pins 128 and 130 are spaced apart sufficiently to maintain the elastomer springs 136 taut without substantial pretensioning. Pretensioning of the elastomer springs can shorten the useful lives of the springs.

To debark a log 36 the cylinder 134 is extended and rotates the cutter arm 30 about shaft 32, lowering the cutting head 82 and placing the cutting head against the log. The weights of the cutter arm 30 and the cutter head assembly 80 urge the cutter head to rotate in the downward direction towards the log support 14, biasing the cutter head 82 against log 36.

Rotating cutter arm 30 from its elevated position elongates the elastomer springs 136, thereby generating a spring force applied to the cutter arm 30 urging the cutter arm to rotate in the upward direction about shaft 32. The spring force attempts to raise the cutter arm and acts against the weight of the cutter arm 30 and cutter head assembly 80 attempting to lower the cutter arm 30. The spring force counters the weight of the cutter arm 30 and cutter head assembly 80 so that the cutting head 82 is not biased against log 36. The elastomer springs allow the cutter head to float over the log throughout its range of motion between the elevated and lowered positions.

The operator controls debarking engagement the cutter head and the log and the rotary position of the arm by actuating valve 144. When it is necessary to pivot the cutter head to a lower position the valve is actuated to flow hydraulic fluid into line 148 and from line 146 to extend cylinder 134. When it is necessary to raise the cutter head the valve is actuated to flow hydraulic fluid into line 146 and from line 148 to retract cylinder 134. In this way, the operator maintains cutter head 82 against the rotating log 36 despite changes in log diameter.

Nitrogen in accumulators 150 and 152 is at the same pressure so that when valve 144 is in the normal closed position the hydraulic fluid in lines 146 and 148 is at the same pressure and cylinder 134 is biased outwardly toward the extended position due to the larger working area of the head end of the piston and the smaller working area of the rod end of the piston. In this way, cutter head 82 is held against the rotating log at a desired debarking pressure of about 100 to 200 pounds throughout the pivot range of arm 60 and there is no need to adjust the pressure of the nitrogen in the accumulators as the arm is pivoted.

Logs frequently are not smooth and have inward recesses and outward projections which have to be debarked. Head 82 closely follows the surface of the log into depressions and out along projections. The elastomer springs 136 cushion inward and outward pivoting of the arm in response to irregularities on the log to maintain improved debarking engagement between the head and the log. The head is not abruptly moved away from the log-by-log irregularities. The head may be forced away from or move in toward the log, however, it does not move far away from the log and rapidly recontacts the log for renewed debarking. The head does not slam down against the log but lands softly onto engagement with the log without bouncing. The improved engagement between the head and log is believed to result from the relatively slow response time of the elastomer shock cord spring to forces tending to elongate or release the spring for contraction.

The floating engagement between the head and the log speeds debarking by maintaining the head in improved engagement with the log without rebound gouging of the log. Debarking is continuous as the diameter of the log varies. The operator does not need to adjust the pressure of the nitrogen in the accumulators as the arm is pivoted through its range of operation.

In the disclosed log debarking machine 10 the pivot connection supporting pivot arm 60 at shaft 62 is located between cutter head 82 and elastomer springs 136 and hydraulic cylinder 134. The springs and cylinder are attached to the outer end of the arm. See FIG. 2.

If desired, either or both of the elastomer spring and cylinder may be located between the pivot shaft 62 and head 82 on a support located above arm 60. The elastomer spring supports the weight of the arm from above during debarking. The hydraulic cylinder positions the arm from above for debarking different size logs.

In log debarking machine 10 the cutter head assembly is mounted on the inner end of a pivotable debarking arm 60. Rotation of the arm about pivot shaft 52 moves the assembly toward and away from the log support to debark logs of different sizes. Other types of mounting arrangements for the assembly may be used. For instance, the cutter head assembly can be mounted on car assembly 22 by a parallelogram linkage for movement of the cutter head assembly toward and away from the rotary log support. An elastomer spring extending from the assembly to an attachment on the car supports the weight of the cutter head assembly. A hydraulic cylinder, similar to cylinder 134, provides contact force between the cutter head assembly and the log.

Alternatively, the cutter head assembly can be mounted on a vertical slide located above a log on the log support and mounted on the car assembly for up and down movement. The weight of the cutter head assembly can be supported by an elastomer spring mounted between the assembly on the slide and the top of the slide. A hydraulic cylinder, like cylinder 134, can be mounted between the assembly and the slide to provide the contact force between the assembly and the log during debarking.

While I have illustrated and described preferred embodiments of my invention, it is understood that this is capable of modification, and I therefore do not wish to be limited to the precise details set forth, but desire to avail myself of such changes and alterations as fall within the purview of the following claims.

What I claim as my invention is:

1. Apparatus for removing bark from logs, the apparatus comprising:

an elongate base; a rotary log support on the base; a log support drive to rotate a log on the log support during debarking; a rail on the base, the rail extending along one side of the log support; a car movably mounted on the rail; a car drive on the base to move the car to a desired position for debarking a log on the log support; a debarking arm on the car, the arm having an inner end located over the log support and an outer end away from the log support; a rotary cutter head on the inner end of the arm to debark a log on the log support; a pivot connection between the arm and the car permitting pivoting of the arm to move the head toward and away from the log support; and an elastomer spring, the elastomer spring having a first end coupled to the arm and a second end coupled to the car to support the head during movement of the head toward and away from a log rotated by the log support, wherein the head follows the surface of the log and debarks depressions and projections on the log.

2. Apparatus as in claim 1 including a cylinder connected between the car and the arm to bias the head against a log during debarking.

3. Apparatus as in claim 2 wherein the pivot connection is located between the head and the elastomer spring.

4. Apparatus as in claim 3 wherein the pivot connection is located between the head and the cylinder.

5. Apparatus as in claim 1 wherein the elastomer spring includes a spring member having a plurality of elongate, parallel and closely packed elastomer strands, and a sheath surrounding the strands.

6. Apparatus as in claim 5 wherein said strands are rubber.

7. Apparatus as in claim 6 wherein the elastomer spring comprises a plurality of lengths of bungee cord.

8. Apparatus as in claim 7 wherein each bungee cord has a diameter of about 1 inch.

9. Apparatus as in claim 2 wherein said spring includes a row of elastomer cords and said cylinder is located between two adjacent cords in the row.

10. Apparatus as in claim 1 including an elastomer spring tensioning assembly.

11. Apparatus for removing bark from logs, the apparatus comprising:

a rotary log support; and a debarker assembly including, a body located adjacent the log support, a pivot arm having an inner end located over the log support, a rotary debarking head on the inner end of the arm for debarking logs rotated by the log support, a pivot connection between the arm and the body wherein the arm is pivotable to move the head between elevated and lowered positions for engagement with different size logs on the log support, and an elastomer spring connected between the body and the arm to support the arm during debarking, the elastomer spring arranged to exert a spring force on the arm urging the head towards the elevated position when the head is away from the elevated position.

12. Apparatus as in claim 11 including a device connected between the body and the arm to pivot the arm between such positions.

13. Apparatus as in claim 11 including a rail running along the rotary log support;

said body comprising a car mounted on the rail, and a drive for rotating the cutter head, the drive including a motor on the car and a drive connection between the motor and the debarking head.

14. Apparatus as in claim 13 wherein the drive connection includes a drive belt.

15. Apparatus as in claim 12 wherein the pivot connection is located between the head and the elastomer spring.

16. Apparatus as in claim 15 wherein the pivot connection is located between the head and the device.

17. Apparatus as in claim 11 including an elastomer spring tensioning assembly.

18. Apparatus as in claim 11 wherein the arm includes an arm frame, a cutter head assembly; said head rotatably mounted in the cutter head assembly, and a rotary connection between the arm frame and the cutter head assembly, wherein during debarking the head pivots and follows the surface of a log.

19. Apparatus as in claim 11 wherein said elastomer spring includes a spring member having plurality of elongate, parallel and closely packed rubber strands and a sheath surrounding the strands.

20. Apparatus as in claim 19 wherein the elastomer spring includes a plurality of said spring members.

21. Apparatus as in claim 20 wherein each spring member comprises a bungee cord having a diameter of about 1 inch.

22. Apparatus as in claim 20 wherein said elastomer spring comprises a plurality of bungee cords arranged in a row and including a cylinder connected between the arm and the body and located in the row.

23. Apparatus as in claim 11 wherein the elastomer spring comprises a rubber spring.

24. Apparatus for removing bark from logs, the apparatus comprising:

a rotary log support; and a debarker assembly including, a body located adjacent the log support, a head support member, a rotary debarking head on the member for debarking logs rotated by the log support, a mounting connection between the member and the body wherein the rotary debarking head is movable between elevated and lowered positions, and an elastomer spring connected between the member and the body to support the rotary debarking head during debarking, the elastomer spring arranged to exert a spring force on the member urging the rotary debarking head toward the elevated position.

25. Apparatus as in claim 24 wherein said connection is a pivot connection.

* * * * *